US006283574B1

(12) United States Patent
Sugimoto et al.

(10) Patent No.: US 6,283,574 B1
(45) Date of Patent: Sep. 4, 2001

(54) INK-JET PRINTING APPARATUS AND CLEANING CONTROL METHOD OF THE SAME

(75) Inventors: Hitoshi Sugimoto; Kaneji Yamada, both of Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/399,111

(22) Filed: Sep. 20, 1999

(30) Foreign Application Priority Data

Sep. 22, 1998 (JP) ..... 10-268604

(51) Int. Cl.[7] ..... B41J 2/165
(52) U.S. Cl. ..... 347/23; 347/33
(58) Field of Search ..... 347/23, 29, 33, 347/35

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,170,186 | | 12/1992 | Shimamura et al. | 347/23 |
| 5,406,317 | | 4/1995 | Shimamura et al. | 347/23 |
| 5,475,404 | * | 12/1995 | Takahashi et al. | 347/23 |
| 5,499,043 | * | 3/1996 | Osaka | 347/108 |
| 5,701,146 | | 12/1997 | Akiyama et al. | 347/26 |
| 5,793,388 | * | 8/1998 | Martinson et al. | 347/19 |
| 5,798,775 | | 8/1998 | Takahashi et al. | 347/33 |
| 5,805,180 | | 9/1998 | Ebisawa et al. | 347/23 |
| 5,896,143 | | 4/1999 | Matsui et al. | 347/24 |

FOREIGN PATENT DOCUMENTS

| | | |
|---|---|---|
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 3-5154 | 1/1991 | (JP) . |
| 4-358846 | 12/1992 | (JP) . |
| 7-125228 | 5/1995 | (JP) . |

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

Disclosed are an ink-jet printing apparatus and cleaning control method capable of reducing density variations in printed images by controlling the number of times of wiping during image printing and capable of printing without lowering the throughput. A dot counter counts printing dots printed by ink droplets discharged from a printing head. A wiping flag "A" is set on the basis of the result of comparison of this count value with a predetermined threshold value. By referring to this wiping flag "A", whether the ink discharge surface of the printing head is to be cleaned with a blade while the printing head is printing one page of a printing sheet is determined. When the printing sheet printed by the printing head is to be discharged, whether the ink discharge surface of the printing head is to be cleaned with the blade is determined by referring to a wiping flag "B" that is set on the basis of the result of comparison of the value of Nd with another threshold value.

16 Claims, 12 Drawing Sheets

INK-JET PRINTING APPARATUS AND CLEANING CONTROL METHOD OF THE SAME

BACKGROUND OF THE INVENTION

1. Field of the Invention

The present invention relates to an ink-jet printing apparatus and a cleaning control method of the same and, more particularly, to an ink-jet printing apparatus having a function of cleaning the ink discharge surface of a printing head for printing an image on a printing medium by discharging an ink, and a cleaning control method of the apparatus.

2. Description of the Related Art

An ink-jet printing method has been conventionally used in printing units of printers and copying machines because of, e.g., its low noise, low running cost, ease of apparatus miniaturization, and ease of color printing.

In printing according to this ink-jet printing method, a printing head discharges ink droplets onto a printing medium such as an OHP film. Therefore, fine ink drops (mist) formed in addition to the discharged ink droplets or ink drops discharged onto the printing medium and splashing the discharge surface of the printing head. If a large amount of this splashing ink gathers on discharge openings of the printing head or if foreign matters such as paper dust particles adhere to this ink, the ink discharge is interfered with. Consequently, the ink is discharged in an unexpected direction or no ink droplets are discharged to cause discharge errors.

To solve this problem, therefore, conventional ink-jet printing apparatuses include a mechanism for wiping the discharge opening surface of a printing head with a blade formed by an elastic member such as rubber by using relative motion between them. This mechanism functions as a means for removing an unnecessary ink, paper dust, and the like sticking to the printing head by mist and/or splashes of ink drops from a printing medium.

This wiping operation is an important technique to improve the reliability of an ink-jet printing apparatus. Additionally, as a means for removing foreign matters sticking to the discharge opening surface of a printing head without being completely removed by the wiping operation, an ink-jet printing apparatus has a suction recovering mechanism constructed of a cap covering the discharge surface of the printing head and a suction pump connected to this cap. An ink is forcedly drawn out from an ink discharge nozzle of the printing head by the negative pressure generated by the suction pump. Since this removes an ink with an increased viscosity and/or foreign matters, normal discharge is recovered.

The wiping operation of the conventional ink-jet printing apparatuses is so controlled as to be executed in accordance with one or both of the printing time and the number of dots (printing dots) of an ink discharged from a printing head. This wiping operation is generally so set that the operation is executed before the wetness of an ink adhered to the discharge opening surface of a printing head brings about discharge errors.

Furthermore, in Japanese Patent Laid-Open No. 7-125228, the number of printing dots and the printing time are measured, and the timing of the wiping operation during printing is controlled on the basis of each of the number of printing dots and printing time measured.

This prior art, however, performs only control for determining whether the wiping operation is executed during image printing.

Accordingly, in a serial type ink-jet printing apparatus which prints images by reciprocating, in the direction (main scanning direction) perpendicular to the conveyance direction (sub-scanning direction) of a printing medium, a carriage mounting a printing head having an array of a plurality of ink discharge nozzles, if the wiping operation is executed during printing, the printing density of a printed portion immediately after this wiping operation changes. As a consequence, a density variation occurs in the printed image.

This density variation also occurs when each pixel on a printing medium is printed by overlapping a plurality of ink droplets or when printing is performed using a multipath printing method (also called a fine printing method) of forming an image by scanning the same region a plurality of number of times by a printing head. If, however, printing is executed in predetermined rhythm, the penetration of an ink into a printing medium also becomes uniform, and the image density stabilizes. In contrast, if the predetermined rhythm breaks owing to the wiping operation during printing or the like, the penetration of an ink into a printing medium also changes discontinuously to cause an ink density change. This density change is presumably visually sensed as a variation.

SUMMARY OF THE INVENTION

It is, therefore, an object of the present invention to provide an ink-jet printing apparatus capable of reducing density variations in printed images by controlling the number of times of wiping during image printing and capable of printing without lowering the throughput, and a cleaning control method of the apparatus.

According to the present invention, the above object is achieved by an ink-jet printing apparatus for printing an image by discharging an ink from a printing head onto a printing medium, comprising discharging means for discharging the printing medium outside the apparatus, wiping means for cleaning an ink discharge opening surface of the printing head, counting means for counting dots of ink droplets discharged from the printing head, first determining means for determining, on the basis of a counted result from the counting means, whether the ink discharge opening surface of the printing head is to be cleaned by the wiping means while the printing head is printing one page of the printing medium, and second determining means for determining, on the basis of the counted result from the counting means, whether the ink discharge opening surface of the printing head is to be cleaned by the wiping means when the printing medium printed by the printing head is discharged by the discharging means.

An apparatus with this arrangement has various embodiments.

That is, the apparatus can further comprise first interrupting means for comparing a first predetermined threshold value with the counted result from the counting means by performing interrupt processing at predetermined time intervals immediately before or during printing, and second interrupting means for comparing a second predetermined threshold value with the counted result from the counting means by performing interrupt processing when the discharging means delivers the printing medium printed by the printing head. Desirably, the first predetermined threshold value is larger than the second predetermined threshold value. More desirably, the second predetermined threshold value is 60 to 80% of the first predetermined threshold value.

Preferably, the first determining means performs the determination by using a compared result obtained by the first interrupting means, and the second determining means performs the determination by using a compared result obtained by the second interrupting means.

Another embodiment further comprises measuring means for measuring an elapsed time from a last cleaning operation by the wiping means. If this is the case, this apparatus further comprises first interrupting means for comparing a first predetermined threshold value with a counted result from the counting means by performing interrupt processing at predetermined time intervals immediately before or during printing, and third interrupting means for comparing a third predetermined threshold value with the elapsed time measured by the measuring means by performing interrupt processing when the discharging means delivers the printing medium printed by the printing head. In this apparatus, the first determining means can perform the determination by using a compared result obtained by the first interrupting means, and the second determining means can perform the determination by using a compared result obtained by the third interrupting means.

The counting means desirably executes the counting while the printing head is performing printing.

The printing head is desirably an ink-jet printing head comprising an electrothermal transducer for generating heat energy to be given to an ink, in order to discharge the ink by using the heat energy.

The above object is achieved by a cleaning control method used when wiping means cleans an ink discharge opening surface of an ink-jet printing head for printing an image by discharging an ink onto a printing medium, comprising the count step of counting printing dots printed by ink droplets discharged from the printing head, the first determination step of determining, on the basis of a counted result in the count step, whether the ink discharge opening surface of the printing head is to be cleaned by the wiping means while the printing head is printing one page of the printing medium, and the second determination step of determining, on the basis of the counted result in the count step, whether the ink discharge opening surface of the printing head is to be cleaned by the wiping means when the printing medium printed by the printing head is discharged.

The above object is achieved by an ink-jet printing apparatus for printing an image by discharging an ink from a printing head onto a printing medium, comprising discharging means for discharging the printing medium outside the apparatus, wiping means for cleaning an ink discharge opening surface of the printing head, counting means for counting dots of ink droplets discharged from the printing head, measuring means for measuring an elapsed time from a last cleaning operation by the wiping means, first determining means for determining, on the basis of a counted result from the counting means, whether the ink discharge opening surface of the printing head is to be cleaned by the wiping means while the printing head is printing one page of the printing medium, and second determining means for determining, on the basis of the elapsed time measured by the measuring means, whether the ink discharge opening surface of the printing head is to be cleaned by the wiping means after the discharging means delivers the printing medium.

In addition to this arrangement, the apparatus may further comprise first interrupting means for comparing a first predetermined threshold value with the counted result from the counting means by performing interrupt processing at predetermined time intervals immediately before or during printing, and second interrupting means for comparing a second predetermined threshold value with the elapsed time measured by the measuring means by performing interrupt processing when the discharging means delivers the printing medium printed by the printing head.

In this arrangement, the first determining means may perform the determination by using a compared result obtained by the first interrupting means, and the second determining means may perform the determination by using a compared result obtained by the second interrupting means.

The above object is achieved by a cleaning control method used when wiping means cleans an ink discharge opening surface of an ink-jet printing head for printing an image by discharging an ink onto a printing medium, comprising the count step of counting printing dots printed by ink droplets discharged from the printing head, the measurement step of measuring an elapsed time from a last cleaning operation, the first determination step of determining, on the basis of a counted result in the count step, whether the ink discharge opening surface of the printing head is to be cleaned by the wiping means while the printing head is printing one page of the printing medium, and the second determination step of determining, on the basis of the elapsed time measured in the measurement step, whether the ink discharge opening surface of the printing head is to be cleaned by the wiping means after the printing medium is discharged.

In the above arrangement, before the wiping means cleans the ink discharge opening surface of the printing head for printing an image by discharging an ink onto a printing medium, dots of ink droplets discharged from the printing head are counted. On the basis of this counted result, whether the ink discharge surface of the printing head is to be cleaned by the wiping means while the printing head is printing one page of the printing medium is determined. In addition, when the discharging means is to deliver the printing medium printed by the printing head, whether the ink discharge surface of the printing head is to be cleaned by the wiping means is determined on the basis of this counted result or the elapsed time from the last cleaning operation by the wiping means.

According to the present invention, therefore, before the wiping means cleans the ink discharge opening surface of the printing head for printing an image by discharging an ink onto a printing medium, dots of ink droplets discharged from the printing head are counted. On the basis of this counted result, whether the ink discharge surface of the printing head is to be cleaned by the wiping means while the printing head is printing one page of the printing medium is determined. In addition, when the discharging means is to deliver the printing medium printed by the printing head, whether the ink discharge surface of the printing head is to be cleaned by the wiping means is determined on the basis of this counted result or the elapsed time from the last cleaning operation by the wiping means. Accordingly, the frequency of wiping operation occurring during printing of one page of the printing medium reduces. This can effectively reduce density variations appearing in printed images owing to density changes caused by this wiping operation.

Additionally, this reduction of the wiping operation frequency can prevent lowering the throughput caused by the wiping operation.

Furthermore, the reliability of ink discharge from the printing head can be well maintained by the wiping operation performed at proper timings.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
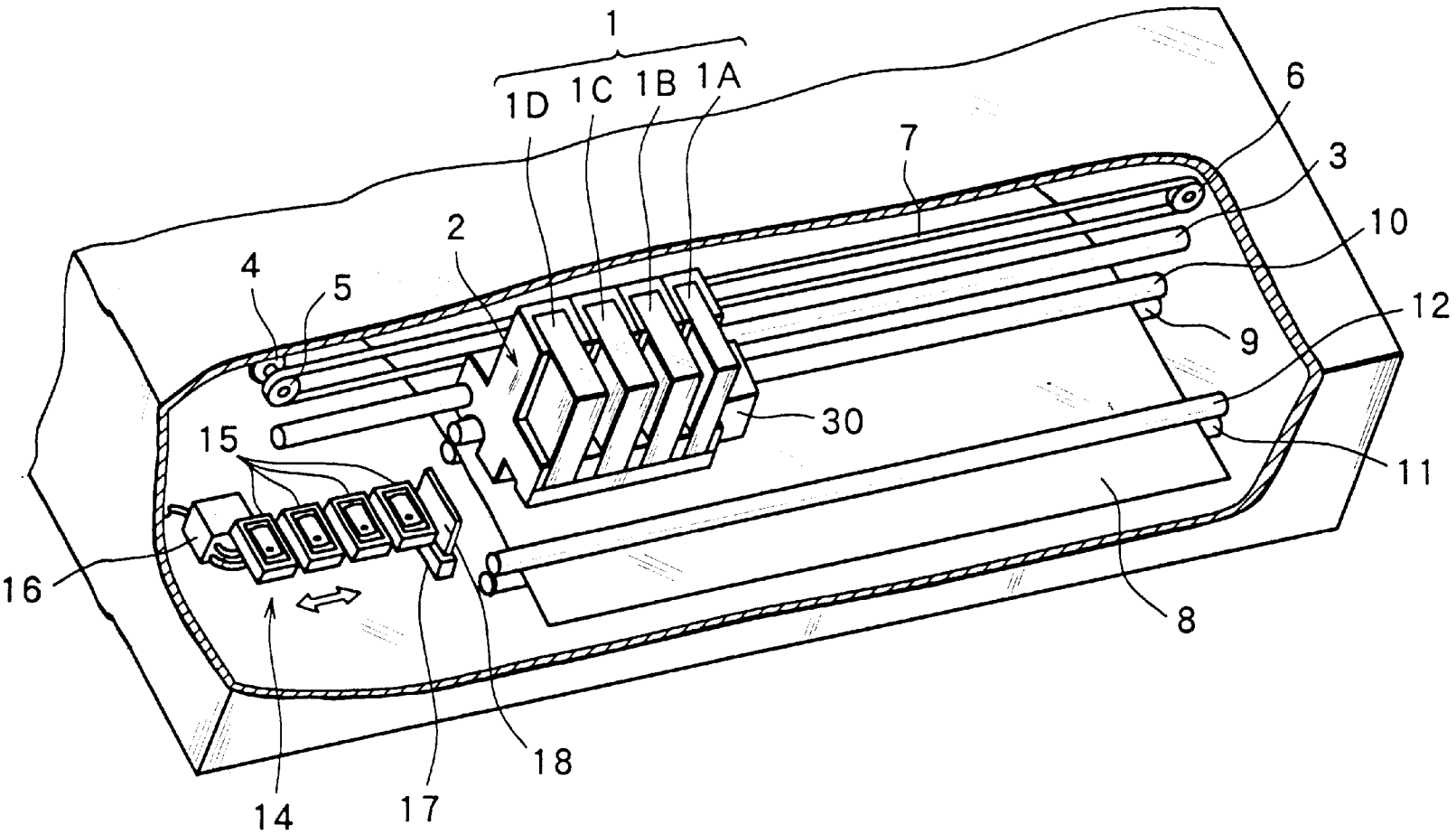
FIG. 1 is a partially cutaway perspective view showing an outline of an ink-jet printing apparatus as a representative embodiment of the present invention.

FIG. 1 is a partially cutaway perspective view showing an outline of an ink-jet printing apparatus as a representative embodiment of the present invention.

Referring to FIG. 1, a head cartridge 1 has ink tanks and printing heads placed below these ink tanks. As shown in FIG. 1, to perform color printing, this head cartridge 1 has: a Y head cartridge 1A including an ink tank containing a yellow (Y) ink and a printing head for discharging this yellow ink; an M head cartridge 1B including an ink tank containing a magenta (M) ink and a printing head for discharging this magenta ink; a C head cartridge 1C including an ink tank containing a cyan (C) ink and a printing head for discharging this cyan ink; and a K head cartridge 1D including an ink tank containing a black (K) ink and a printing head for discharging this black ink. These four head cartridges are detachable from the printing apparatus and exchangeable independently of each other.

In the following explanation, to refer to all of the four head cartridges, the term "head cartridge 1" is used. Also, to refer to all of the four printing heads corresponding to the four head cartridges, the term "printing head 1*a*" is used. Note that each cartridge has a connector to receive a signal for driving the printing head and the like.

A carriage 2 mounts the head cartridge 1. This carriage 2 has connector holders to be electrically connected to the connectors of the printing heads of the four head cartridges. The carriage 2 can go and return along a guide shaft 3 extended in the moving direction (main scanning direction) of the carriage 2. More specifically, the driving force of a carrier motor 4 is transmitted to the carriage 2 via a motor pulley 5, a driven pulley 6, and a timing belt 7. This driving force moves the carriage 2 reciprocally in directions indicated by the double-headed arrow in FIG. 1.

A printing medium 8 such as a printing sheet is conveyed through a position (printing position) facing the discharge opening surface of the printing head 1*a* by a pair of conveyor rollers 9 and 10, and a pair of conveyor rollers 11 and 12, positioned before and after, respectively, the printing position of the printing head 1*a* to convey the printing medium by clamping it. A platen (not shown) supports the back side of this printing medium 8 so as to form a flat printing surface in the printing position. That is, the printing head 1*a* of the head cartridge 1 mounted on the carriage 2 is positioned between the conveyor rollers 10 and 12 by protruding downward from the carriage 2, and the discharge opening formation surface of the printing head opposes parallel to the printing surface of the printing medium 8.

In the ink-jet printing apparatus of this embodiment, a recovery system unit 14 is disposed on the home position side of the carriage 2 on the left-hand side of FIG. 1.

In this recovery system unit 14, caps 15 are arranged in one-to-one correspondence with the discharge opening surfaces of the head cartridge 1 and can move vertically. When the carriage 2 is in home position, the caps 15 cap the ink discharge opening surfaces of the printing head 1*a* by connecting to them. This prevents discharge errors due to an increase in the ink viscosity occurring when an ink evaporates from an ink discharge opening of the printing head by drying, to solidification of the ink, or to sticking of dust particles to the ink discharge opening surface of the printing head. Also, the caps 15 communicate with a pump 16. If discharge error occurs in the printing head 1*a* or no ink is present in its discharge opening, the caps 15 are connected to the ink discharge opening surface of the printing head 1*a*. A suction recovery operation is performed by generating negative pressure in the caps by using the pump 16 and expelling an ink by suction.

A blade 18 is a wiping member formed of an elastic member such as rubber. A blade holder 17 holds this blade 18. The blade 18 is generally made of a material softener than the head so as not to damage the ink discharge opening surface of the printing head. Also, the blade 18 is often made of an elastic member to increase the allowance for the relative positional relationship between the blade 18 and the printing head 1*a*. Practical examples of the material used as the blade 18 are elastic materials such as natural rubber, nitrile rubber, butadiene rubber, chloroprene rubber, butyl rubber, chlorinated butyl rubber, silicone rubber, polystyrene rubber, polyvinyl chloride, and polyurethane rubber. Also, a foamed material or a sintered material such as polyurethane or polyethylene is used in some instances.

In this embodiment, a blade elevating mechanism (not shown) driven by the movement of the carriage 2 can vertically move the blade 18 held by the blade holder 17 between a position (wiping position) where the blade 18 projects (moves up) to wipe an ink sticking to the ink discharge opening surface of the printing head 1*a* and a position (waiting position) where the blade 18 retracts (moves down) so as not to interfere with the ink discharge opening surface of the printing head 1*a*. In this embodiment, the blade 18 moves up to the wiping position when the carriage 2 moves to the cap position as the home position shown on the left-hand side of FIG. 1. When the carriage 2 moves from this cap position to the printing region (on the right-hand side of FIG. 1), the blade 18 moves, relative to the carriage 2, while contacting the ink discharge opening surface of the printing head 1*a,* thereby wiping the surface. When the carriage 2 further moves to the printing region and the blade 18 comes off from the ink discharge opening surface, the blade 18 moves down to the waiting position and does not interfere with the ink discharge opening surface any longer.

If no ink discharge is performed continuously for a certain time, inks evaporate by drying from ink discharge openings of the printing head 1*a,* with the result that the discharge performance lowers to deteriorate the quality of printed images. To prevent this, in ink-jet printing apparatuses, an operation called pre-discharge is generally performed by which ink discharge is performed to expel inks from ink discharge nozzles at predetermined time intervals in a predetermined location regardless of printing data, thereby supplying fresh inks to these nozzles.

Note that the printing head 1*a* discharges inks by using heat energy, so each ink discharge nozzle incorporates an electrothermal transducer for generating heat energy.

Figure 2:
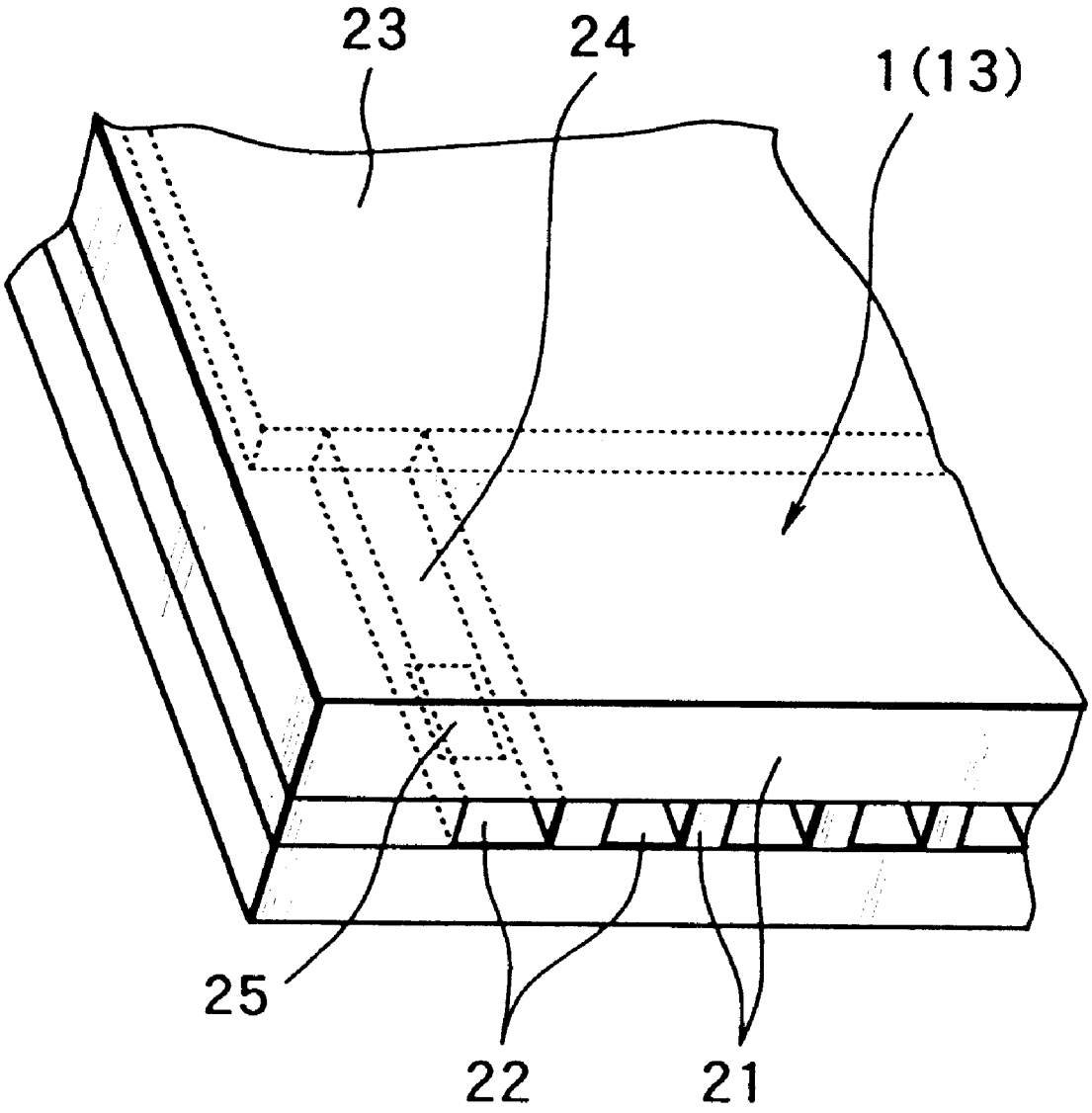
FIG. 2 is a partial perspective view schematically showing the structure of an ink discharge portion (printing discharge portion) 13 of a printing head 1*a;*

FIG. 2 is a partial perspective view schematically showing the structure of an ink discharge portion (printing discharge portion) 13 of the printing head 1*a*.

Referring to FIG. 2, a plurality of ink discharge openings 22 are formed at predetermined pitches in an ink discharge opening surface 21 facing the printing medium 8 with a predetermined spacing (e.g., about 0.5 to 2.0 mm). An electrothermal transducer (e.g., a heating resistor) 25 for generating energy for ink discharge is placed along a wall surface of each liquid path 24 which connects a common liquid compartment 23 and the corresponding ink discharge opening 22.

In this embodiment, the printing head 1*a* is mounted on the carriage 2 with a positional relationship by which ink discharge openings 22 are arranged in a direction perpendicular to the main scanning direction of the carriage 2. When a driving signal is input to the printing head 1*a,* the electrothermal transducer 25 generates heat energy, and this heat energy causes film boiling in an ink in the corresponding liquid path 24 and forms a bubble. Printing is performed by pressure generated by growth and shrinkage of this bubble.

Figure 3:
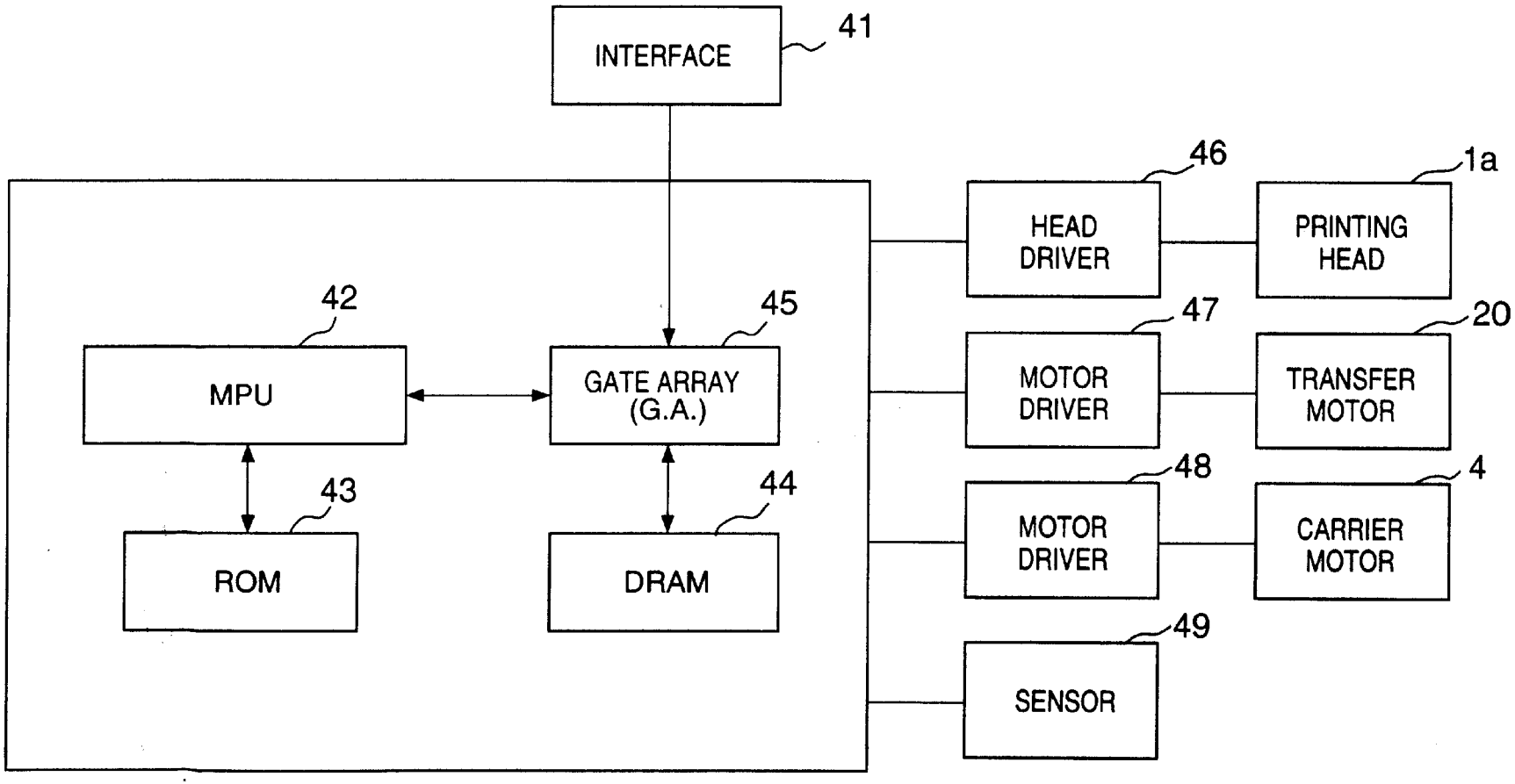
FIG. 3 is a block diagram showing the control system of the ink-jet printing apparatus.

FIG. 3 is a block diagram showing the control system of the ink-jet printing apparatus having the above construction.

Referring to FIG. 3, an interface 41 receives print signals from a host computer (to be referred to as a host hereinafter). A microprocessor unit (MPU) 42 controls the overall apparatus. A ROM 43 stores control programs executed by the MPU 42. A DRAM 44 stores print signals and various data such as printing data to be supplied to the printing head 1*a*. This DRAM 44 can also store the number of printing dots and the printing time.

A gate array (G.A.) 45 controls supply of printing data to the printing head 1*a* and also controls data transfer between the interface 41, the MPU 42, and the DRAM 44. A transfer motor 20 conveys printing sheets. A head driver 46 drives the printing head 1*a*. Motor drivers 47 and 48 drive the transfer motor 20 and the carrier motor 4, respectively.

Sensors 49 include a sensor for sensing the presence/absence of a printing sheet, a sensor for sensing the home position of the carriage 2, and a sensor for sensing the temperature of the printing head. Outputs from these sensors are transmitted to the MPU 42. This enables the MPU 42 to monitor the position of the carriage 2, the presence/absence of a printing medium, and the ambient temperature.

In this control system with the above configuration, when the interface 41 receives a print signal, this print signal is converted into image data for printing between the gate array 45 and the MPU 42. The motor drivers 47 and 48 are driven, and the printing head 1*a* is driven in accordance with the image data supplied to the head driver 46, thereby printing the data.

A wiping operation executed in the printing apparatus having the above arrangement will be described below.

Figure 4:
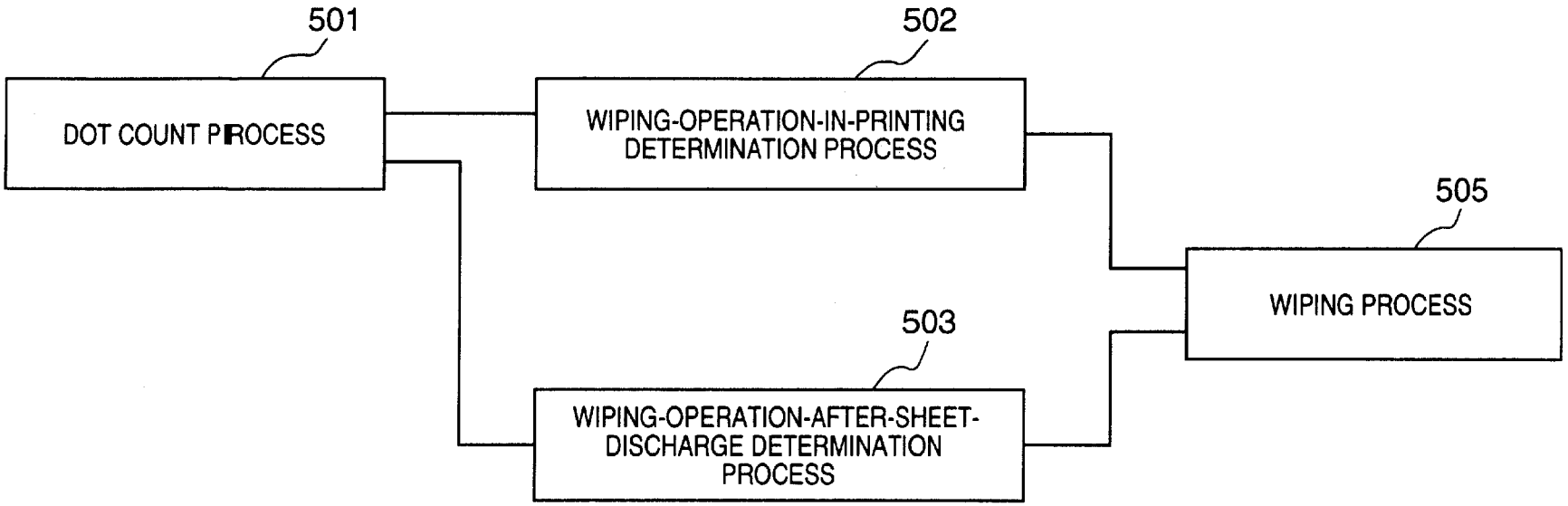
FIG. 4 is a block diagram showing the relationship between four processes associated with a wiping operation.

FIG. 4 is a block diagram showing the relationship between four processes associated with the wiping operation.

As depicted in FIG. 4, this wiping operation is composed of: a dot count process 501 of counting the number of dots discharged from the ink discharge openings of the printing head 1*a;* a wiping-operation-in-printing determination process 502 of determining the timing of wiping during printing; a wiping-operation-after-sheet-discharge determination process 503 of determining the timing of wiping after a printed sheet is discharged; and a wiping process 505 of actually wiping the ink discharge opening surface of the printing head 1*a*.

Details of this wiping operation will be described below with reference to the flow charts shown in FIGS. 5 to 7.

Figure 5:
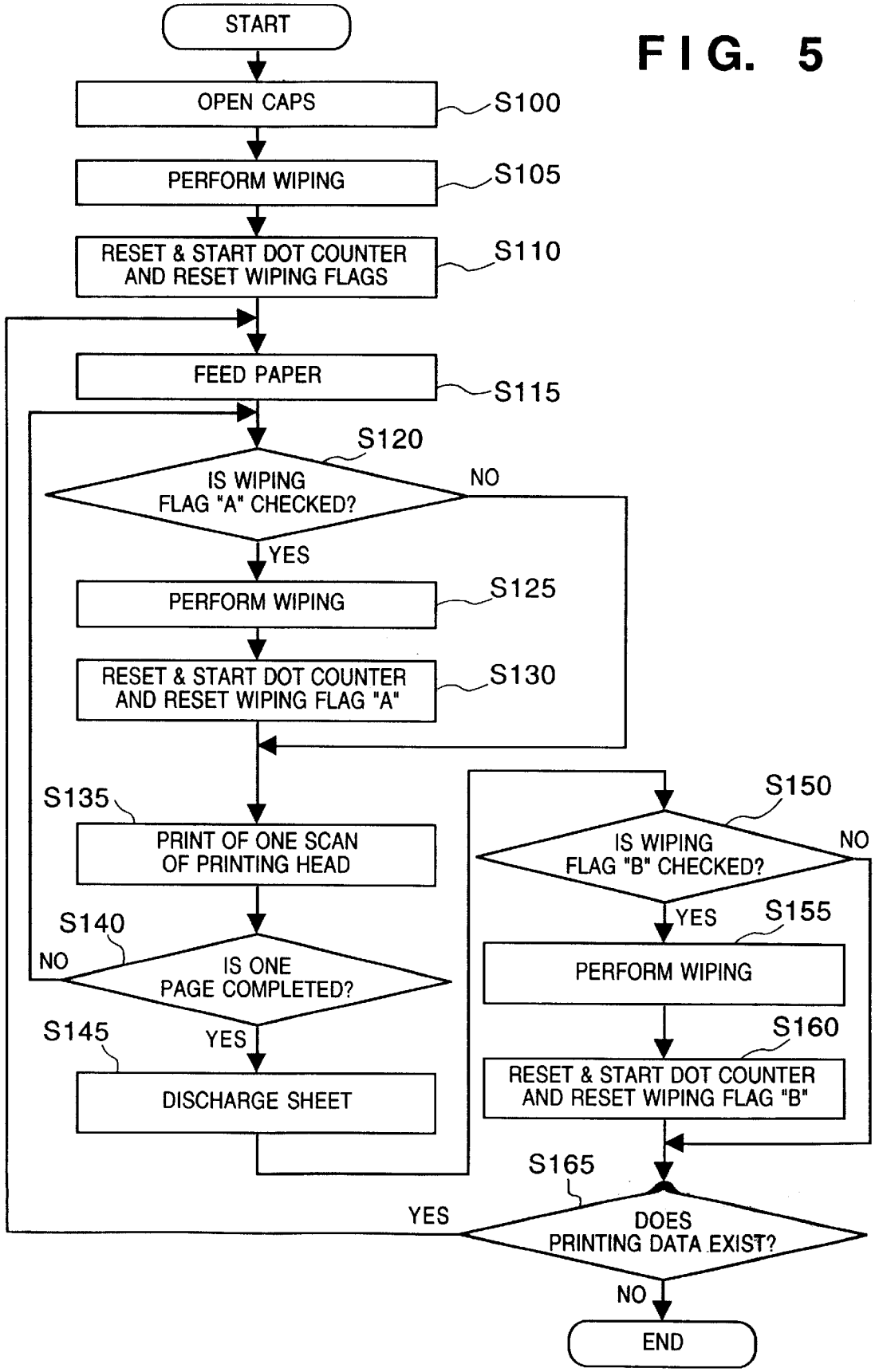
FIG. 5 is a flow chart of a wiping control operation.

FIG. 5 is a flow chart of a wiping control operation. FIG. 6 is a flow chart showing predetermined-time-interval (50 msec) interrupt processing for determining a wiping operation during printing. FIG. 7 is a flow chart showing interrupt processing performed after a printed sheet is discharged to determine a wiping operation after the sheet discharge.

In this embodiment, whether wiping is to be executed is determined by performing interrupt processing at predetermined time intervals. If the conditions of wiping are met, a wiping flag (WFLG) defined in the DRAM 44 is set, and whether the wiping operation is performed is controlled by referring to this wiping flag (WFLG) before data is printed by the next scan of the printing head. Interrupt processing is also performed when a printed sheet is discharged to check whether wiping is to be executed. If the conditions of wiping are met, the wiping flag (WFLG) is set, and whether the wiping operation is to be performed is controlled by referring to this wiping flag (WFLG) after the printed sheet is discharged.

First, the wiping operation will be described with reference to the flow chart in FIG. 5.

Upon receiving a printing start instruction from the host, the caps 15 are removed from the printing head 1*a* in step S100. In step S105, the wiping operation is executed. In step S110, a dot counter (Nd) and wiping flags are reset to start counting the number of printing dots. The wiping flags are two: a wiping flag "A" (WFLGA) and a wiping flag "B" (WFLGB). In this embodiment, these two wiping flags are used for convenience. However, no such two wiping flags need to be used.

In step S115, a printing sheet is fed. In step S120, the value of the wiping flag "A" is checked. If the wiping flag "A" is set (WFLGA=1), the flow advances to step S125 to execute the wiping operation by using the blade 18. After this wiping operation, the flow advances to step S130 to reset the value of the dot counter (Nd) and the value of the wiping flag "A" (WFLGA). After that, the flow advances to step S135. On the other hand, if the wiping flag "A" is not set (WFLGA=0), the flow advances to step S135 by skipping steps S125 and S130.

In step S135, data of one scan of the printing head 1*a* is printed. During this printing, the MPU 42 uses the dot counter (Nd) to count the number of dots formed by ink discharge on the basis of the printing data. This count can also include the number of pre-discharged dots formed regardless of the printing data.

In step S140, whether printing of one page of a printing sheet is completed is checked. If the printing is found to be completed, the flow advances to step S145 to discharge the printing sheet. If it is determined that the printing is incomplete and to be continued, the flow returns to step S120.

After the printing of one page of the printing sheet is completed and the sheet is discharged, the flow advances to step S150 to check the value of the wiping flag "B" (WFLGB).

If the wiping flag "B" is set (WFLGB=1), the flow advances to step S155 to execute the wiping operation by using the blade 18. After this wiping operation is completed, the flow advances to step S160 to reset the value of the dot counter (Nd) and the value of the wiping flag "B" (WFLGB) After that, the flow advances to step S165.

On the other hand, if the wiping flag "B" (WFLGB) is not set (WFLGB=0), the flow advances to step S165 by skipping steps S155 and S160.

Finally, in step S165 whether printing data still exists is checked, i.e., whether printing data to be printed on the next page exists is checked. If such printing data exists, the flow returns to step S115 to continue the printing operation by feeding a new printing sheet. On the other hand, if no more printing data is transmitted from the host, the operation is completed, and the carriage 2 waits in the printing waiting position. Alternatively, the carriage 2 returns to the home position to cap the printing head 1*a* and waits until the next printing start instruction is transmitted.

Comparing the processes shown in FIG. 4 with the flow chart shown in FIG. 5 indicates that the dot count process 501, wiping-operation-in-printing determination process 502, wiping-operation-after-sheet-discharge determination process 503, and wiping process 505 are executed in steps S135, S120, S150, and S125 plus S155, respectively.

Figure 6:
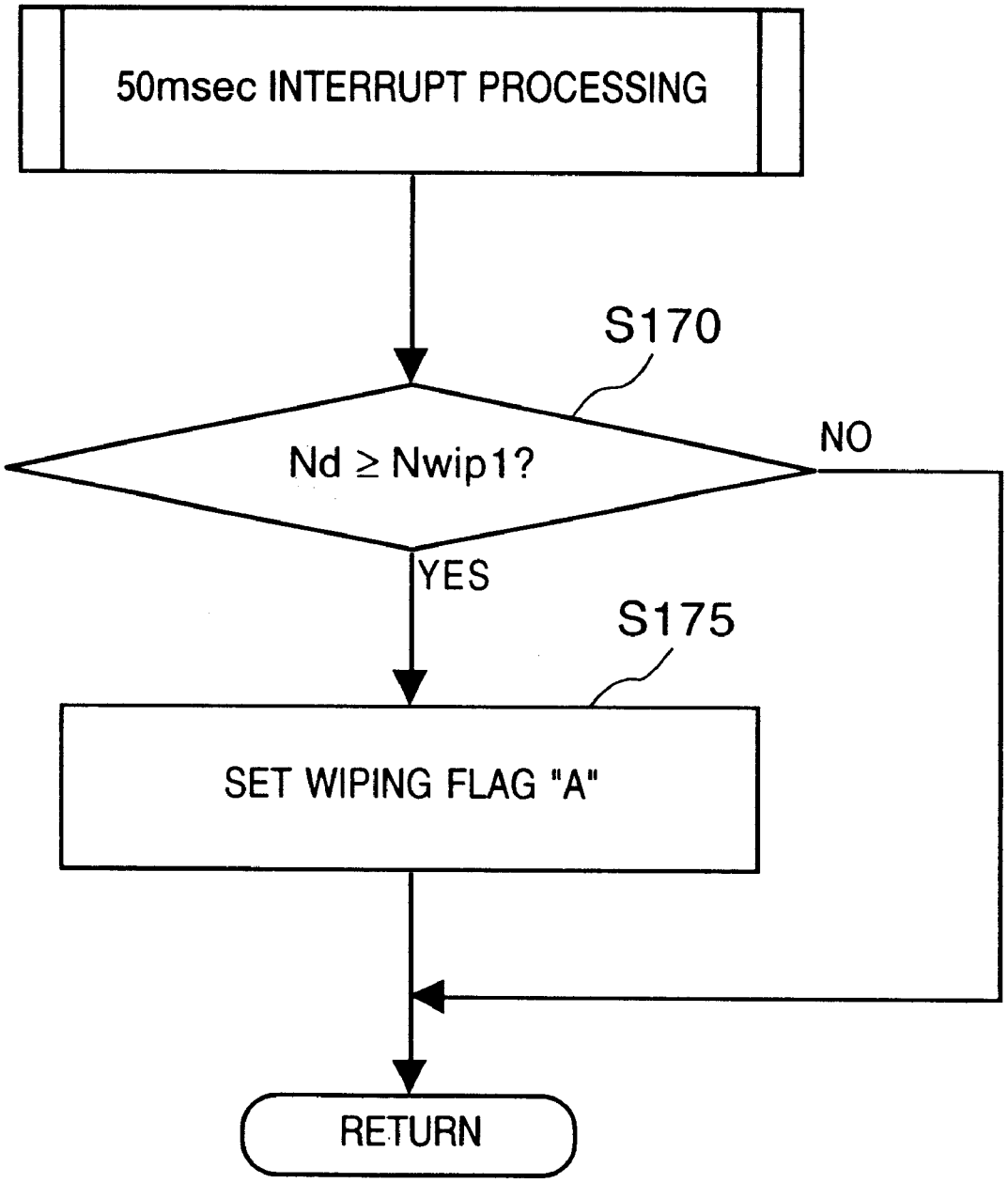
FIG. 6 is a flow chart showing a predetermined-time-interval (50 msec) interrupt processing for determining a wiping operation during printing.
Figure 7:
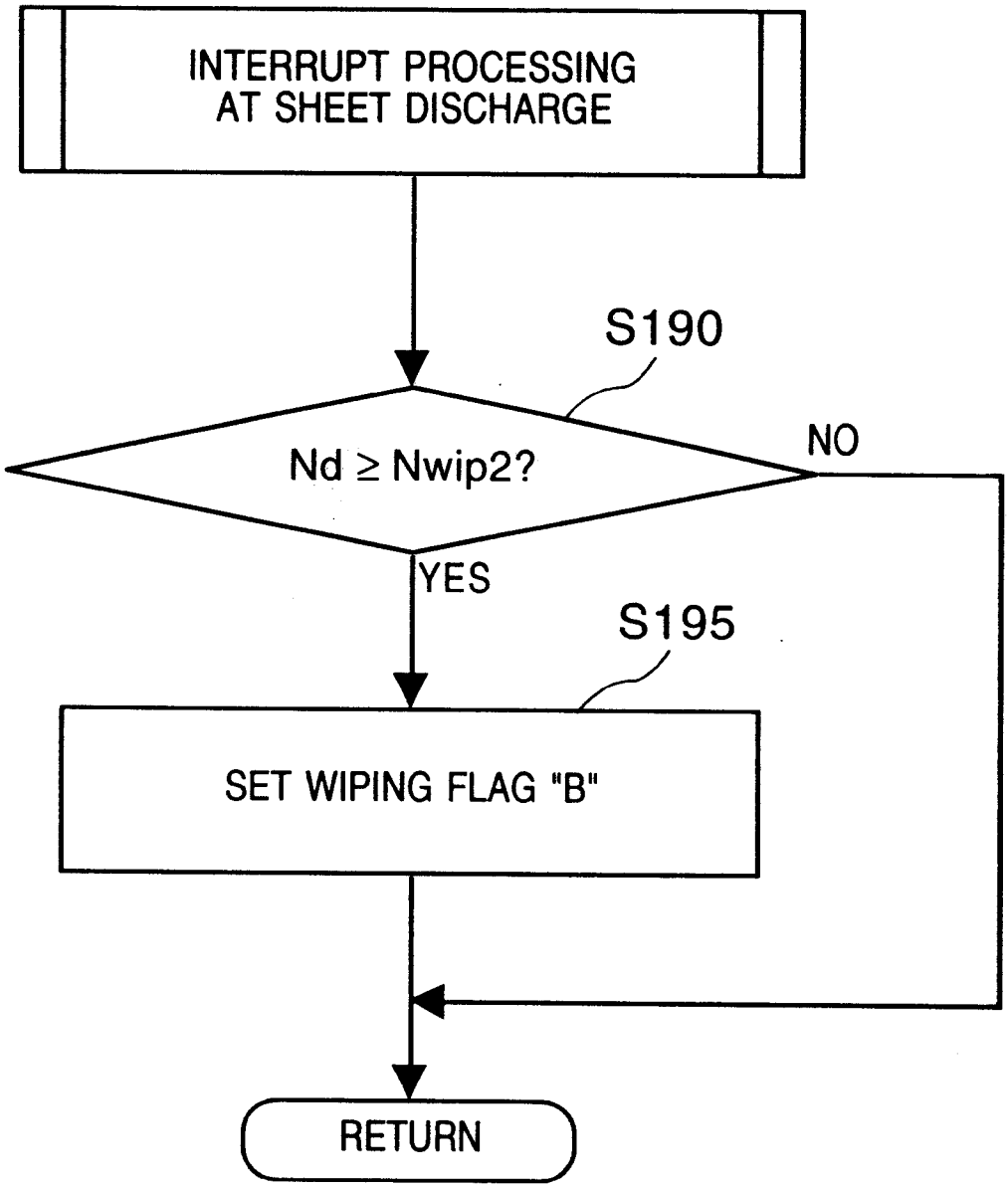
FIG. 7 is a flow chart showing interrupt processing performed after discharge of a printing sheet to determine a wiping operation after the sheet discharge.

The value of the wiping flag "A" (WFLGA) is updated by generating an interrupt at predetermined time intervals (in this embodiment, 50 msec) while the printing operation is executed, i.e., while the process in step S135 is executed, thereby executing the processing shown in the flow chart of FIG. 6. Although the predetermined time interval for an interrupt is set to 50 msec in this embodiment, the time interval is not particularly limited to this value. Also, the interrupt processing can be performed before data of one scan is printed. This interrupt processing will be described below with reference to FIG. 6.

If an interrupt is generated, the value of the dot counter (Nd) which has counted the number of dots formed by ink discharge from the printing head is compared with a predetermined threshold value (Nwip1) in step S170. If Nd≧Nwip1, it is determined that the conditions of wiping are met. Hence, the flow advances to step S175, and the wiping flag "A" (WFAGA) is set (WFLGA=1). If Nd<Nwip1 by which the wiping conditions are not met, the interrupt processing is immediately terminated.

The threshold value (Nwip1) is preferably set to be as large as possible to the extent that no ink discharge direction becomes unstable and/or no ink discharge error occurs owing to ink mist sticking to the discharge opening surface of the printing head 1*a*.

The interrupt processing at sheet discharge will be described below with reference to the flow chart in FIG. 7. In this embodiment, the interrupt timing is when a sheet is discharged. However, this timing can also be immediately before, during or immediately after, sheet discharge.

First, when this interrupt is generated, the value of the dot counter (Nd) is compared with a predetermined threshold value (Nwip2) in step S190.

If Nd≧Nwip2 by which the conditions of wiping are met, the flow advances to step S195 to set the wiping flag "B" (WFLGB) (WFLGB=1). If N<Nwip2 by which the wiping conditions are not met, the interrupt processing is immediately terminated.

In this embodiment, the threshold value (Nwip2) is set to be a smaller value than the threshold value (Nwip1) in the aforementioned interrupt processing at intervals of 50 msec (Nwip2<Nwip1), i.e., Nwip2 is about 70% of Nwip1.

This is so because, even when the value of the dot counter (Nd) has not reached the wiping conditions, if this count value has exceeded 70% of the threshold value (Nwip1), the wiping operation is performed after sheet discharge, and as a consequence the value of the dot counter (Nd) is reset. Therefore, even when printing of the next page successively occurs, it is possible to reduce the probability that the wiping operation is executed during this printing.

That is, when the value of the dot counter (Nd) is approaching the threshold value (Nwip1), the probability that the wiping operation is executed in earlier stages of printing of the next page is high. Hence, the count value is compared with Nwip2, a smaller threshold value, when a sheet of the preceding page is discharged, and the wiping operation is executed before printing of the next page starts. Consequently, one wiping operation can sometimes be omitted during printing of the next page.

On the other hand, if the value of the threshold (Nwip2) is too small, the probability that the wiping operation is executed every time a sheet discharge rises, and this lowers the throughput. Accordingly, it is presumably preferable to set the value of Nwip2 to about 60 to 80% of the value of Nwip1.

In this embodiment as described above, the apparatus is so controlled that the wiping operation is executed under predetermined conditions after a printed sheet is discharged. This reduces the wiping frequency during printing of a printing sheet of the next one page. Consequently, it is possible to reduce a density variation due to a printing density change caused by the wiping operation during printing of one page of a printing sheet, and thereby print high-quality images. Also, the reduction of wiping frequency can prevent lowering the printing throughput.

Additionally, the reliability of ink discharge can be well maintained because wiping is dependably executed before ink discharge error occurs owing to adhesion of ink mist to the discharge opening surface of the printing head.

[Another Embodiment]

In the above embodiment, the value of the wiping flag is controlled in accordance with the count value of the dot counter (Nd). In accordance with this wiping flag value, whether the wiping operation is to be executed during printing and after a printed sheet is discharged is determined. In this embodiment, whether the wiping operation is to be executed is determined by also taking account of the elapsed time from the preceding wiping operation.

Figure 8:
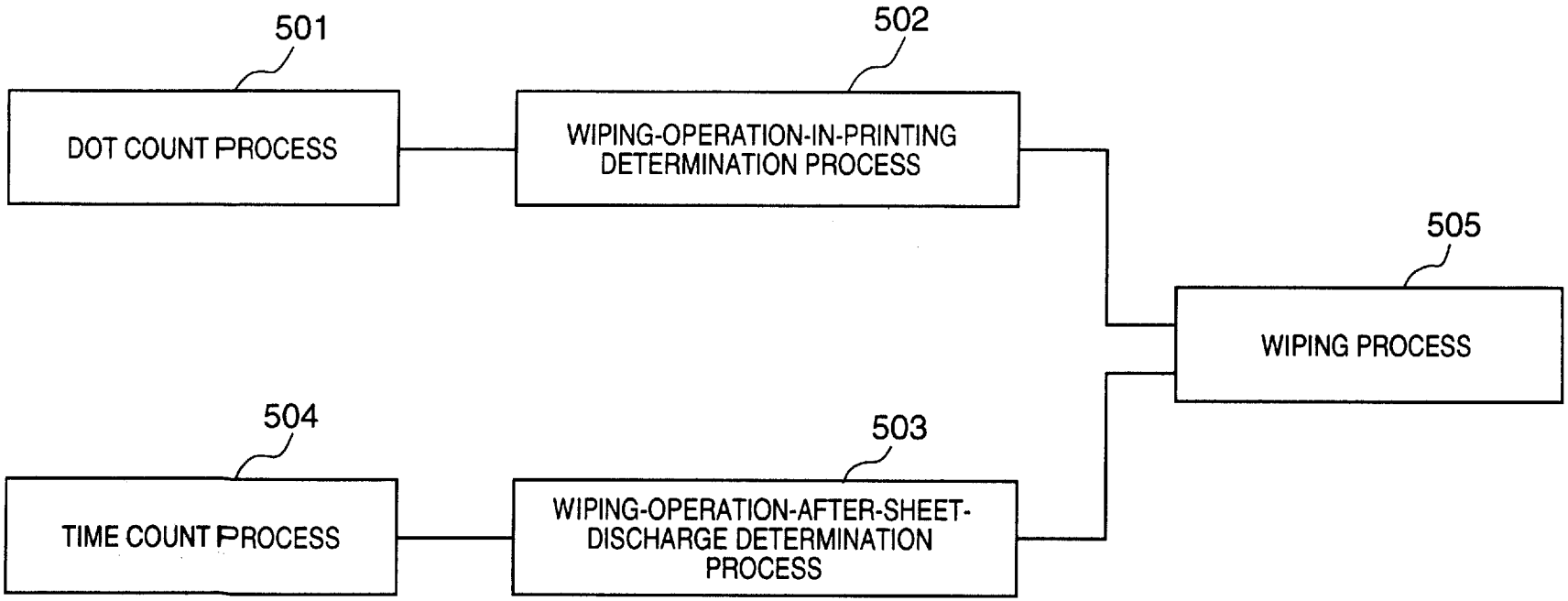
FIG. 8 is a block diagram showing the relationship between five processes associated with a wiping operation according to another embodiment.

FIG. 8 is a block diagram showing the relationship between five processes associated with this wiping operation. In FIG. 8, the same reference numerals as in the above embodiment denote the same processes, and a detailed description thereof will be omitted.

Referring to FIG. 8, wiping operation execution control of this embodiment has a time count process 504 for counting the elapsed time from the preceding wiping operation, in addition to the control of the above embodiment.

Details of this wiping operation will be described below with reference to the flow charts shown in FIGS. 9 and 10.

Figure 9:
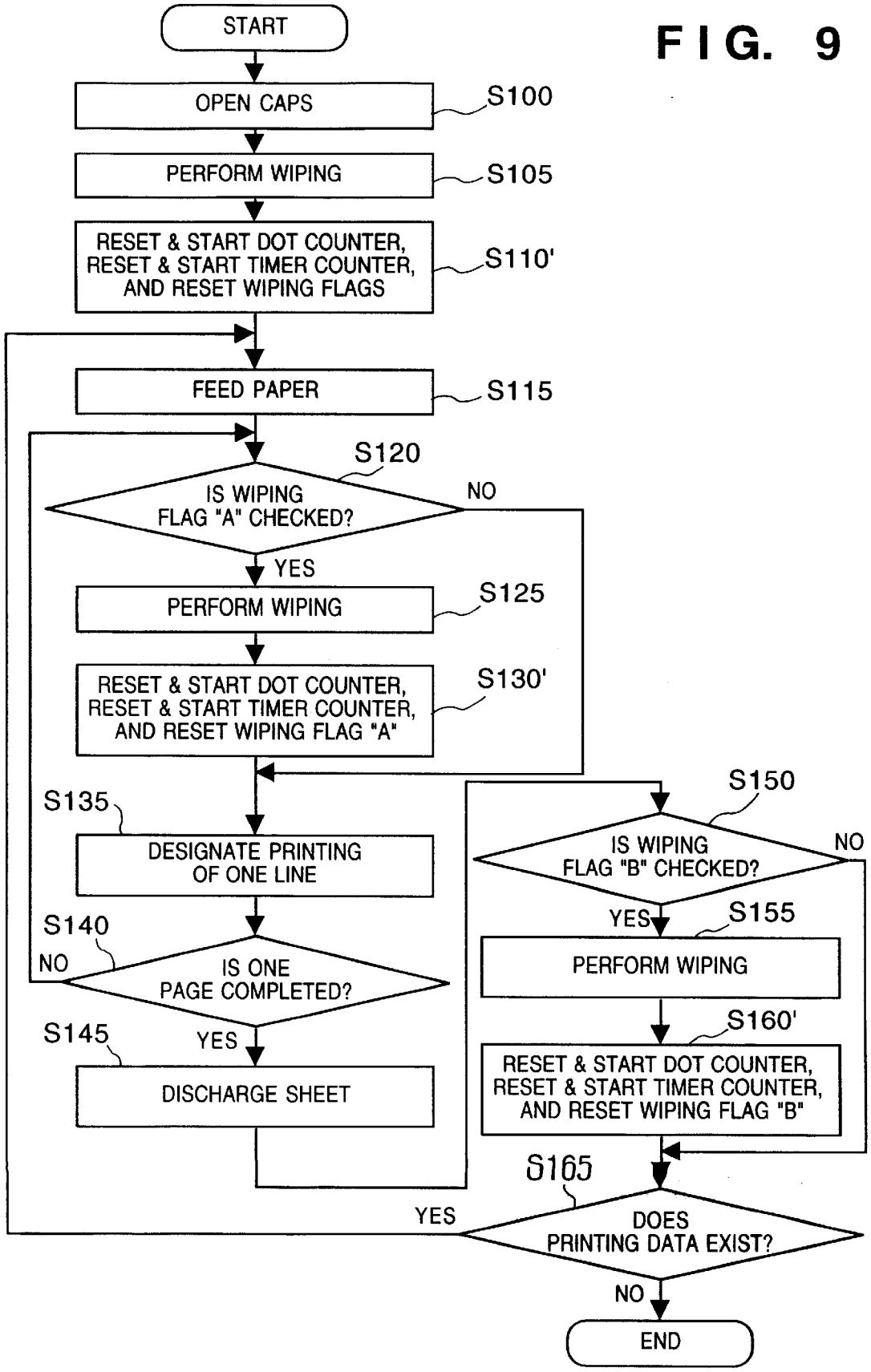
FIG. 9 is a flow chart of a wiping control operation according to the embodiment shown in FIG. 8.
Figure 10:
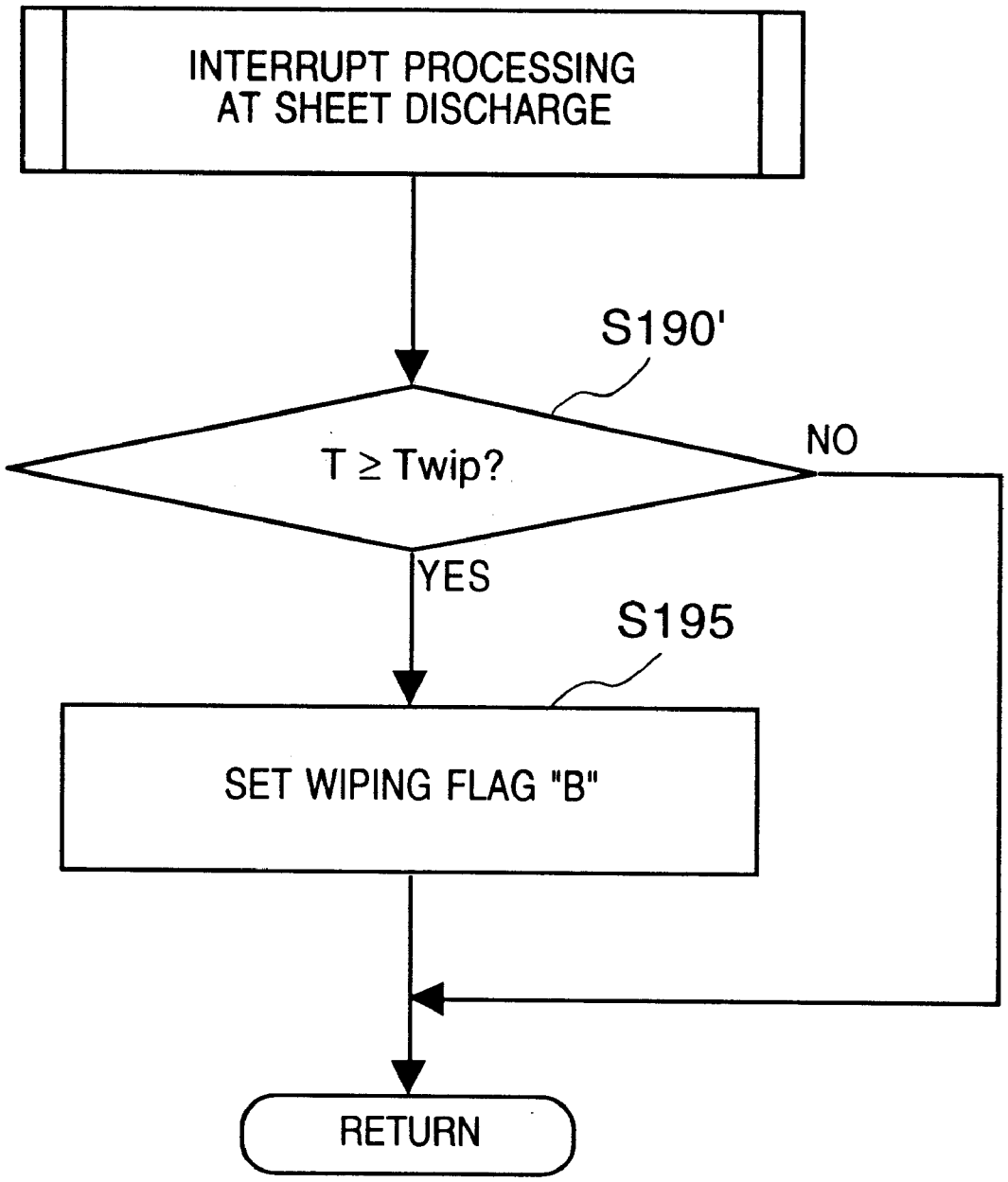
FIG. 10 is a flow chart showing interrupt processing after sheet discharge according to the embodiment shown in FIG. 8.

FIG. 9 is a flow chart of a wiping control operation. FIG. 10 is a flow chart showing interrupt processing at sheet discharge for determining the wiping operation after a printed sheet is discharged.

In the above embodiment, whether the wiping operation is to be executed during printing of one page of a printing sheet and whether the wiping operation is to be executed after sheet discharge are determined on the basis of the value of the dot counter (Nd). In this embodiment, whether the wiping operation is to be executed during printing of one sheet is determined on the basis of the count value of a dot counter (Nd). Whether the wiping operation is to be executed after sheet discharge is determined on the basis of the elapsed time from the preceding wiping operation, which is measured in the time count process 504.

Wiping control according to this embodiment will be described next with reference to the flow chart in FIG. 9. In FIG. 9, the same step numbers as in the above embodiment denote the same processing steps already described, so a detailed description thereof will be omitted. In the following description, only characteristic processes of this embodiment will be explained.

First, upon receiving a printing start instruction, the flow advances to step S110' through steps S100 to S105. In step S110', the values of all of the dot counter (Nd), a time counter (T), and wiping flags (WFLGA and WFLGB) are reset, and counting of the number of printing dots and time measurement by the time counter are started.

If the wiping operation is executed during printing, the flow advances to step S130' after that. In step S130', the values of the dot counter (Nd) and the time counter (T) are reset (Nd=0, T=0) to restart these counters, and the wiping flag "A" is also reset (WFLGA=0).

If the wiping operation is executed during processing after sheet discharge, the flow advances to step S160' after that. In step S160', the values of the dot counter (Nd) and the time counter (T) are reset (Nd=0, T=0) to restart these counters, and the wiping flag "B" is also reset (WFLGB=0).

As interrupt processing during execution of printing, processing similar to that explained in the above embodiment with reference to FIG. 6 is executed.

The interrupt processing at sheet discharge will be described below with reference to the flow chart in FIG. 10.

When this interrupt is generated, the flow advances to step S190' to compare the value of the time counter (T) with a predetermined threshold value (Twip). If T≧Twip, it is determined that the conditions of wiping are met. Therefore, the flow advances to step S195 to set the wiping flag "B". If T<Twip, it is determined that the wiping conditions are not met, and the interrupt processing is immediately terminated.

In this embodiment, as in the above embodiment, the interrupt timing can be any of immediately before, during, and immediately after sheet discharge.

An ink adhered to the ink discharge opening surface of a printing head 1*a* gradually evaporates to increase its viscosity with the lapse of time. So, if the time passes too long, the ink cannot be satisfactorily removed only with a blade 18. As in the above embodiment, therefore, execution of the wiping operation after sheet discharge is determined in accordance with the elapsed time from the preceding wiping. That is, the apparatus is so controlled that the wiping operation is executed while the ink viscosity is not so high and cleaning is readily possible. This allows high-quality wiping to be maintained.

Additionally, if the threshold value (Twip) is set by also taking the throughput during printing into consideration, the wiping operation is not executed whenever a sheet is discharged, preventing lowering the throughput. Furthermore, when the wiping operation is executed during sheet discharge, the value of the dot counter (Nd) is reset at that timing. Consequently, the frequency of wiping operation during printing of one page of a printing sheet can be reduced. This can suppress deterioration of the image quality due to a density variation by the wiping.

[Still Another Embodiment]

Figure 11:
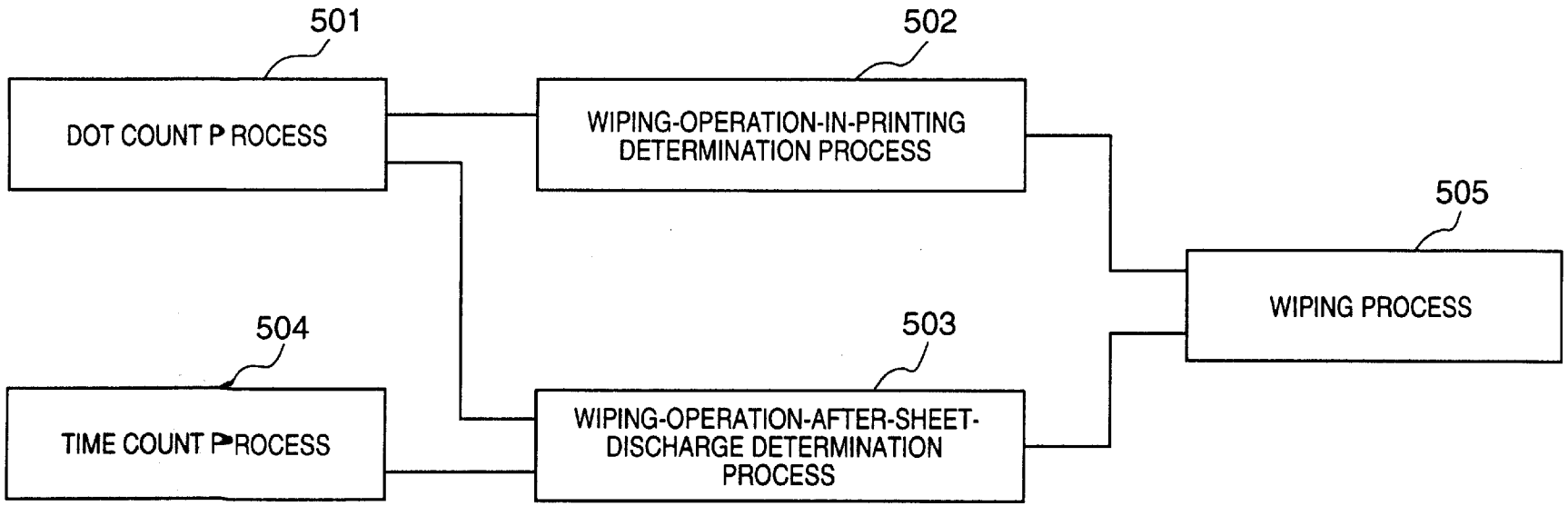
FIG. 11 is a block diagram showing the relationship between five processes associated with a wiping operation according to still another embodiment.

FIG. 11 is a block diagram showing the relationship between five processes associated with a wiping operation according to this embodiment. In FIG. 11, the same reference numerals as in the aforesaid embodiment denote the same processes, and a detailed description thereof will be omitted.

In the above embodiment, whether the wiping operation is to be executed during printing of one page of a printing sheet is determined on the basis of the count value of the dot counter (Nd). Also, whether the wiping operation is to be executed after sheet discharge is determined on the basis of the elapsed time from the preceding wiping operation. In this embodiment, as shown in FIG. 11, whether the wiping operation is to be executed after sheet discharge can be determined by taking account of both the count value of a dot counter (Nd) and the elapsed time from the preceding wiping operation, which is measured by a time counter (T).

Figure 12:
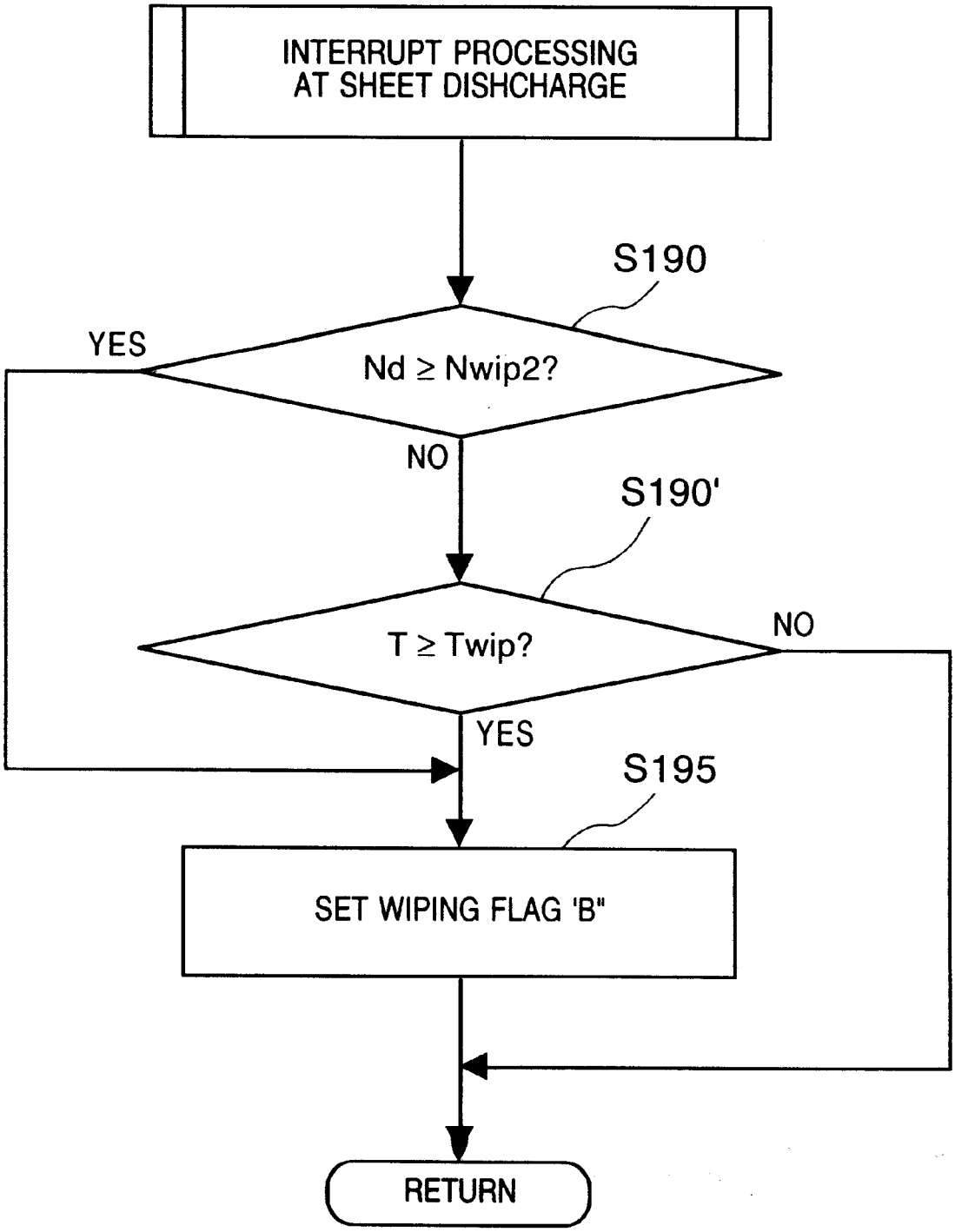
FIG. 12 is a flow chart showing interrupt processing according to the embodiment shown in FIG. 11.

Interrupt processing at paper discharge will be described below with reference to the flow chart shown in FIG. 12. This process is a combination of the above two embodiments.

That is, when this interrupt processing occurs, the value of the dot counter (Nd) is compared with a predetermined threshold value (Nwip2) in step S190.

If the compared result is Nd≧Nwip2 by which the conditions of wiping are met, the flow advances to step S195 to set a wiping flag "B" (WFLGB=1). If Nd<Nwip2 by which the wiping conditions are not met, the flow advances to step S190' without setting this wiping flag "B".

In step S190', the value of the time counter (T) is compared with a predetermined threshold value (Twip). If T≧Twip, it is determined that the wiping conditions are met. Therefore, the flow advances to step S195 to set the wiping flag "B". If T<Twip, it is determined that the wiping conditions are not met, and the interrupt processing is immediately terminated.

In this embodiment, step S190 as the condition determination step using the dot counter is performed prior to step S190' as the condition determination step using the time counter. However, this order may be reversed.

By executing this processing, the characteristic features of the above two embodiments can be combined.

In each of the above embodiments, droplets discharged from the printing head are ink droplets, and a liquid contained in each ink tank is an ink. However, this content is not restricted to an ink. For example, each ink tank can also contain a processing solution which is discharged onto a printing medium in order to increase the fixing property, the water resistance, and/or the image quality of a printed image.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet printing apparatus for printing an image by discharging an ink from a printing head onto a printing medium, comprising:

discharging means for discharging the printing medium outside said apparatus;

wiping means for cleaning an ink discharge opening surface of said printing head;

counting means for counting the number of ink droplets discharged from said printing head after a last cleaning operation by said wiping means;

first determining means for determining, on the basis of a compared result obtained by comparing a first predetermined value with a counted result from said counting means, whether the ink discharge opening surface of said printing head is to be cleaned by said wiping means while said printing head is printing one page of the printing medium, wherein the first determining means determines to perform cleaning when the counted result is equal to or larger than the first predetermined value, and determines not to perform the cleaning when the counted result is less than the first predetermined value; and second determining means for determining, on the basis of a compared result obtained by comparing a second predetermined value with the counted result from said counting means, whether the ink discharge opening surface of said printing head is to be cleaned by said wiping means when the printing medium printed by said printing head is discharged by said discharging means, wherein the second determining means determines to perform the cleaning when the counted result is equal to or larger than the second predetermined value, and determines not to perform the cleaning when the counted result is less than the second predetermined value, and wherein the first predetermined value is larger than the second predetermined value.

2. The apparatus according to claim 1, further comprising:

first interrupting means for comparing the first predetermined threshold value with the counted result from said counting means by performing interrupt processing at predetermined time intervals immediately before or during printing; and second interrupting means for comparing the second predetermined threshold value with the counted result from said counting means by performing interrupt processing when said discharging means discharges the printing medium printed by said printing head.

3. The apparatus according to claim 1, wherein the second predetermined threshold value is 60 to 80% of the first predetermined threshold value.

4. The apparatus according to claim 2, wherein said first determining means performs the determination by using a compared result obtained by said first interrupting means, and said second determining means performs the determination by using a compared result obtained by said second interrupting means.

5. The apparatus according to claim 2, further comprising measuring means for measuring an elapsed time from a last cleaning operation by said wiping means.

6. The apparatus according to claim 5, further comprising third interrupting means for comparing a third predetermined threshold value with the elapsed time measured by said measuring means by performing interrupt processing when said discharging means delivers the printing medium printed by said printing head.

7. The apparatus according to claim 6, wherein said first determining means performs the determination by using a compared result obtained by said first interrupting means, and said second determining means performs the determination by using compared results obtained by said second and third interrupting means.

8. The apparatus according to claim 1, wherein said counting means executes the counting while said printing head is performing printing.

9. The apparatus according to claim 1, wherein said printing head is an ink-jet printing head comprising an electrothermal transducer for generating heat energy to be given to an ink, in order to discharge the ink by using the heat energy.

10. A cleaning control method used when wiping means cleans an ink discharge opening surface of an ink-jet printing head for printing an image by discharging an ink onto a printing medium, comprising:

the count step of counting the number of ink droplets discharged from said printing head after a last cleaning operation;

the first determination step of determining, on the basis of a compared result obtained by comparing a first predetermined value with a counted result in the count step, whether the ink discharge opening surface of said printing head is to be cleaned by said wiping means while said printing head is printing one page of the printing medium, wherein cleaning is determined to perform when the counted result is equal to or larger than the first predetermined value, and determined not to perform when the counted result is less than the first predetermined value; and the second determination step of determining, on the basis of a compared result obtained by comparing a second predetermined value with the counted result in the count step, whether the ink discharge opening surface of said printing head is to be cleaned by said wiping means when the printing medium printed by said printing head is discharged, wherein the cleaning is determined to perform when the counted result is equal to or larger than the second predetermined value, and is determined not to perform when the counted result is less than the second predetermined value, and wherein the first predetermined value is larger than the second predetermined value.

11. A computer-readable storage medium storing the cleaning control method according to claim 10.

12. An ink-jet printing apparatus for printing an image by discharging an ink from a printing head onto a printing medium, comprising:

discharging means for discharging the printing medium to an outside of said apparatus;

wiping means for cleaning an ink discharge opening surface of said printing head;

counting means for counting the number of ink droplets discharged from said printing head after a last cleaning operation by said wiping means;

measuring means for measuring an elapsed time from the last cleaning operation by said wiping means;

first determining means for determining, on the basis of a counted result from said counting means, whether the ink discharge opening surface of said printing head is to be cleaned by said wiping means while said printing head is printing one page of the printing medium; and second determining means for determining, on the basis of the elapsed time measured by said measuring means, whether the ink discharge opening surface of said printing head is to be cleaned by said wiping means after said discharging means discharges the printing medium.

13. The apparatus according to claim 12, further comprising:

first interrupting means for comparing a first predetermined threshold value with the counted result from said counting means by performing interrupt processing at predetermined time intervals immediately before or during printing; and second interrupting means for comparing a second predetermined threshold value with the elapsed time measured by said measuring means by performing interrupt processing when said discharging means discharges the printing medium printed by said printing head.

14. The apparatus according to claim 13, wherein said first determining means performs the determination by using a compared result obtained by said first interrupting means, and said second determining means performs the determination by using a compared result obtained by said second interrupting means.

15. A cleaning control method used when wiping means cleans an ink discharge opening surface of an ink-jet printing head for printing an image by discharging an ink onto a printing medium, comprising:

the count step of counting the number of ink droplets discharged from said printing head after a last cleaning operation;

the measurement step of measuring an elapsed time from the last cleaning operation;

the first determination step of determining, on the basis of a counted result in the count step, whether the ink discharge opening surface of said printing head is to be cleaned by said wiping means while said printing head is printing one page of the printing medium; and the second determination step of determining, on the basis of the elapsed time measured in the measurement step, whether the ink discharge opening surface of said printing head is to be cleaned by said wiping means after the printing medium is discharged.

16. A computer-readable storage medium storing the cleaning control method according to claim 15.

* * * * *